US006129136A

United States Patent [19]

Tibbs et al.

[11] Patent Number: 6,129,136

[45] Date of Patent: Oct. 10, 2000

[54] STRIP STEERING

[75] Inventors: Michael Tibbs, Figtree; John Albert Ziegelaar, Farmborough Heights, both of Australia

[73] Assignees: Ishikawajima-Harima Heavy Industries Company Limited, Tokyo, Japan; BHP Steel (JLA) Pty Ltd, Melbourne, Australia

[21] Appl. No.: 09/154,205

[22] Filed: Sep. 16, 1998

[30] Foreign Application Priority Data

Sep. 19, 1997 [AU] Australia ..... PO 9287

[51] Int. Cl.[7] ..... B22D 11/20; B22D 46/00

[52] U.S. Cl. ..... 164/454; 164/4.1; 164/154.4; 164/154.5; 164/154.8

[58] Field of Search ..... 164/454, 413, 164/4.1, 154.4, 154.5, 154.8, 151.1, 151.2, 151

[56] References Cited

U.S. PATENT DOCUMENTS 4,940,076 7/1990 Desamtels et al. ..... 164/151.2

FOREIGN PATENT DOCUMENTS 63-313643 12/1988 Japan ..... 164/154.5
2-55652 2/1990 Japan ..... 164/454

*Primary Examiner*—Harold Pyon
*Assistant Examiner*—I.-H. Lin
*Attorney, Agent, or Firm*—Miles & Stockbridge P.C.; John C. Kerins

[57] ABSTRACT

Method and apparatus for steering a strip along a desired path. The strip 12 is fed along a guide table 13 by a pair of pinch rolls 50 which are of concave formation so as to grip the strip at two laterally spaced locations at the edges of the strip. A pair of fluid cylinder units 52 are independently operable to vary the pressures applied by the rolls at the two gripping locations to steer the strips. The position of the strip is monitored in the vicinity of the rolls 50 by a strip position sensor 51. Steering of the strip is controlled by a control signal derived from the output of sensor 51. The control signal in the sum of three factors the first of which is a measure of an instantaneous value of the lateral position of the strip, the second of which is a measure of an instantaneous lateral traversing velocity of the strip and the third of which is an integration of instantaneous values of the lateral position of the strip over a preceding time interval.

11 Claims, 11 Drawing Sheets

STRIP STEERING

BACKGROUND OF THE INVENTION

This invention relates to feeding of strip material and more particularly to methods and apparatus for steering a travelling strip along a desired path.

There are many circumstances in which strip material must be fed along a linear path and in which it is desirable to provide some steering means whereby the strip material can be steered in a designed path without excessive wandering or skewing of the strip. In the steel industry, for example, there are instances in which steel strip must be fed forwardly, into processing equipment, often at high speed and in which a proper alignment of the strip must be maintained.

The present invention is particularly applicable to the feeding of metal strip produced from a continuous caster such as a twin roll caster.

In a twin roll caster molten metal is introduced between a pair of contra-rotated horizontal casting rolls which are cooled so that metal shells solidify on the moving roll surfaces and are brought together at the nip between them to produce a solidified strip product delivered downwardly from the nip between the rolls. The term "nip" is used herein to refer to the general region at which the rolls are closest together. The molten metal may be poured from a ladle into a smaller vessel or series of vessels from which it flows through a metal delivery nozzle located above the nip so as to direct it into the nip between the rolls, so forming a casting pool of molten metal supported on the casting surfaces of the rolls immediately above the nip. This casting pool may be confined between side plates or dams held in sliding engagement with the ends of the rolls.

After leaving the caster the hot strip may be passed to a coiler on which it is wound into a coil. Before proceeding to the coiler it may be subjected to inline treatment such as a controlled temperature reduction, reduction rolling, full heat treatment or a combination of such treatment steps. The coiler and any in-line treatment apparatus generally applies substantial tension to the strip which must be resisted. Moreover, it is necessary to accommodate differences between the casting speed of the twin roll caster and speed of subsequent in-line processing and coiling. Substantial differences in those speeds may develop particularly during initial start-up and until steady state casting speed is achieved. In order to meet these requirements it has been proposed to allow the hot strip leaving the caster to hang unhindered in a loop from which is passes through one or more sets of pinch rolls into a tensioned part of the line in which the strip may be subjected to further processing and coiling. The pinch rolls provide resistance to the tension generated by the down-line equipment and are also intended to feed the strip into the down-line equipment.

A twin roll strip casting line of this kind is disclosed in U.S. Pat. No. 5,503,217 assigned to Davy McKee (Sheffield) Limited. In this casting line the hot metal strip hangs unhindered in a loop before passing to a first set of pinch rolls which feed the strip though a temperature control zone. After passing through the temperature control zone the strip passes through further sets of pinch rolls before proceeding to a coiler. It may optionally be hot rolled by inclusion of a rolling mill between the subsequent sets of pinch rolls.

As noted in U.S. Pat. No. 5,503,217, strip passing from zero tension to a tension part of a processing line can wander from side to side. This is not acceptable and is overcome by the first set of pinch rolls being used to steer the metal strip into the tensioned part of the processing line. However, it has been found that standard pinch rolls are not properly effective to steer the strip and hold it against the tendency to wander. The pinch rolls can in fact contribute to misalignment and lateral movement of the strip if even small variations develop in the strip to roll contact pressure, the gap between the pinch rolls, or in the profile or cross-section of the cast strip passing between them.

Wandering of the strip not only results in misalignment of the strip in the down-line processing equipment, and it can lead to the transmission of twisting forces back into the hot strip issuing from the casting rolls. This twisting is particularly critical given the strip is at temperatures close to liquidus and thus the strip has little hot strength. In ferrous metal strip these temperatures are well in excess of 1100° C. Thus such twisting can lead to hot lateral tearing of the strip just below the roll nip. In addition the generation of substantial fluctuations in the tensile forces at the edge margins of the strip leads to waviness in the strip margins and the generation of small edge cracks as the strip approaches the pinch rolls. In extreme cases it can even initiate severe lateral mechanical cracking and complete disruption of the strip. Accordingly, wandering of the strip in advance of the pinch rolls remains a critical problem, particularly in the casting of ferrous metal strip. The present invention provides a method and apparatus which can be applied to the steering of the strip in these circumstances to prevent excessive wandering and skewing of the strip. However, it will be appreciated from the ensuing description that the method and apparatus of the invention may be applied to the steering of strip material in other equipment and environments.

SUMMARY OF THE INVENTION

According to the invention there is provided a method of steering a travelling strip along a desired path, comprising:

- gripping the strip by strip feed means at locations spaced laterally of the strip;
- monitoring the position of the cast strip in the vicinity of the strip feed means to detect changes in the lateral position of the strip and the lateral traversing velocity or skew of the strip;
- generating a strip steering control signal dependent on both the instantaneous lateral position of the strip and the lateral traversing velocity or skew of the strip; and
- varying the relative strip gripping intensity of the feed means at said locations to steer the strip in accordance with said control signal.

The skew of the strip is the angular deviation of the strip from the desired direction of forward travel. This deviation is directly related to the instantaneous traversing velocity of the strip, assuming that grip is maintained. Accordingly a measurement of the instantaneous traversing velocity is an effective measure of skew, although the skew could be measured directly as described below.

The lateral traversing velocity or skew of the strip may be measured by continuously differentiating the instantaneous values of the lateral position of the strip. Alternatively, the skew of the strip may be measured directly by monitoring instantaneous positions of the strip at two locations spaced longitudinally of the strip.

Preferably the control signal is generated so as to give more weight to the laterally traversing velocity or skew of the strip than to the instantaneous position of the strip. More specifically, the lateral traversing velocity or skew may be given at least 10 times more weight than the instantaneous position of the strip.

Preferably the control signal is also dependent on integration of instantaneous values of the lateral position of the strip to counteract lateral drift of the strip from a desired centre-line.

Preferably, the contribution to the control signals by the integration of instantaneous values of the lateral position of the strip is given less weight than the contribution of the values of the instantaneous position of the strip. More specifically, the integration values may be given at least 25 times less weight than the strip position values.

Preferably the control signal is generated as the sum of three factors the first of which is a measure of the instantaneous lateral position of the strip, the second of which is a measure of the instantaneous lateral traversing velocity of the strip and the third of which is an integration of instantaneous values of the lateral position of the strip over a preceding time interval.

Preferably the second factor is obtained by filtering signals derived by differentiating processing of instantaneous lateral position measurements over a preceding time interval.

The invention also provides apparatus for steering a travelling strip along a desired path, comprising:

strip gripping means for gripping the strip at locations spaced laterally of the strip;

monitoring means to monitor the position of the strip in the vicinity of the strip feed means to detect changes in the lateral position of the strip and the lateral traversing velocity or skew of the strip;

control signal generating means to generate a strip steering control signal dependent on both the instantaneous lateral position of the strip and the lateral traversing velocity or skew of the strip; and steering control means operable to vary the relative strip gripping intensities of the strip feed means at said locations to steer the strip in accordance with said control signal.

The strip gripping means may comprise a pair of pinch rolls extending laterally of the strip feed direction and means to apply strip gripping pressure between the feed rolls at two locations spaced laterally of the strip feed direction. The steering control means may then comprise means to vary the strip gripping pressure applied to the strip at the two laterally spaced locations in accordance with the steering control signal.

The pinch rolls may have profiles which cause them to grip the strip at two discrete locations spaced laterally of the strip. Those locations may be at the edge margins of the strip. For example, the rolls may have concave profiles so as to grip the strip at its two edges.

Preferably, the monitoring means is positioned to monitor the position of the strip upstream from the strip gripping means.

As mentioned above the invention is particularly applicable to the steering of strip issuing from a twin roll caster. Accordingly the invention specifically provides a method of controlling tracking of ferrous strip issuing from a twin roll strip caster at temperatures above 1100° C., comprising the steps of delivering cast strip downwardly from the nip between a pair of casting rolls of the strip caster, guiding the cast strip in a substantially untensioned state to a strip feed means which feeds the strip away from the strip caster and which serves as a tension barrier against which tension may be applied to the strip downstream from the feed means, monitoring the position of the strip in the vicinity of the strip feed means to detect changes in the lateral position of the strip and the lateral traversing velocity or skew of the strip, generating a strip steering control signal dependent on both the instantaneous lateral position of the strip and the lateral traversing velocity or skew of the strip, and varying the relative strip gripping intensity of the feed means at locations spaced laterally of the strip to steer the strip in accordance with said control signal.

The invention also provides apparatus for continuously casting metal strip comprising a pair of casting rolls forming a nip between them, a metal delivery nozzle for delivery of molten metal into the nip between the casting rolls to form a casting pool of molten metal supported on the casting roll surfaces immediately above the nip, roll drive means to drive the casting rolls in counter-rotational directions to produce a solidified strip of metal delivered downwardly from the nip, strip feed means disposed generally to one side of the caster to receive strip from the caster and feed it away from the caster, strip guide means to guide the strip from the caster to the strip feed means, monitoring means to monitor the position of the strip in the vicinity of the strip feed means to detect changes in the lateral position of the strip and the lateral traversing velocity or skew of the strip, signal generating means to generate a strip steering control signal dependent on both the instantaneous position of the strip and the lateral traversing velocity or skew of the strip, and steering control means operative in response to said control signal to vary the relative strip gripping intensity of the feed means at locations spaced laterally of the strip to steer the strip in accordance with said control signal.

The guide means may comprise a strip support table comprising a series of strip support rolls disposed in advance of the strip feed means to support the strip before it passes through the feed means.

The rolls of the support table may be disposed in an array which extends back from the feed means toward the caster and curves downwardly at its end remote from the feed means such that the strip will hang unhindered in a loop between the strip caster and the guide means.

BRIEF DESCRIPTION OF THE DRAWINGS

In order that the invention may be more fully explained some particular embodiment will be described with reference to the accompanying drawings in which.

DESCRIPTION OF THE PREFERRED EMBODIMENT

Figure 1:
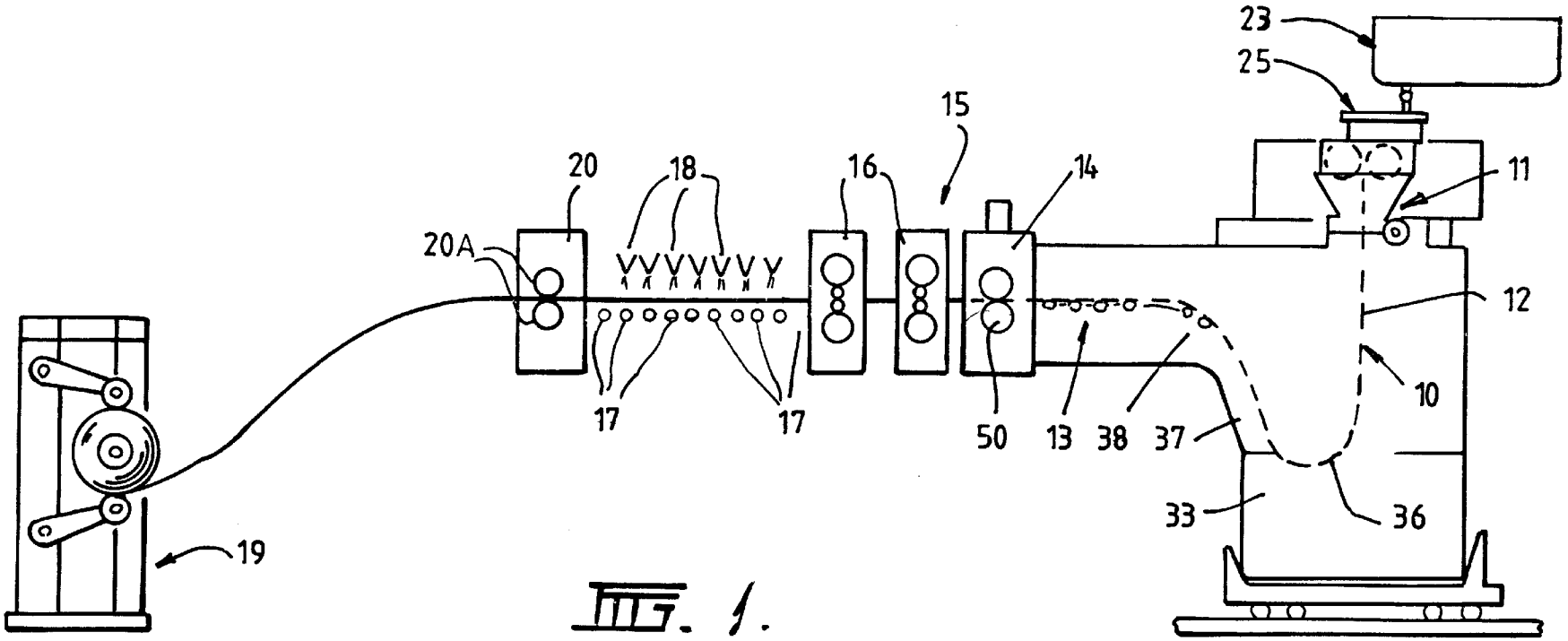
FIG. 1 is a vertical cross-section through a strip casting installation incorporating a strip feeding and steering system in accordance with the invention.
Figure 2:
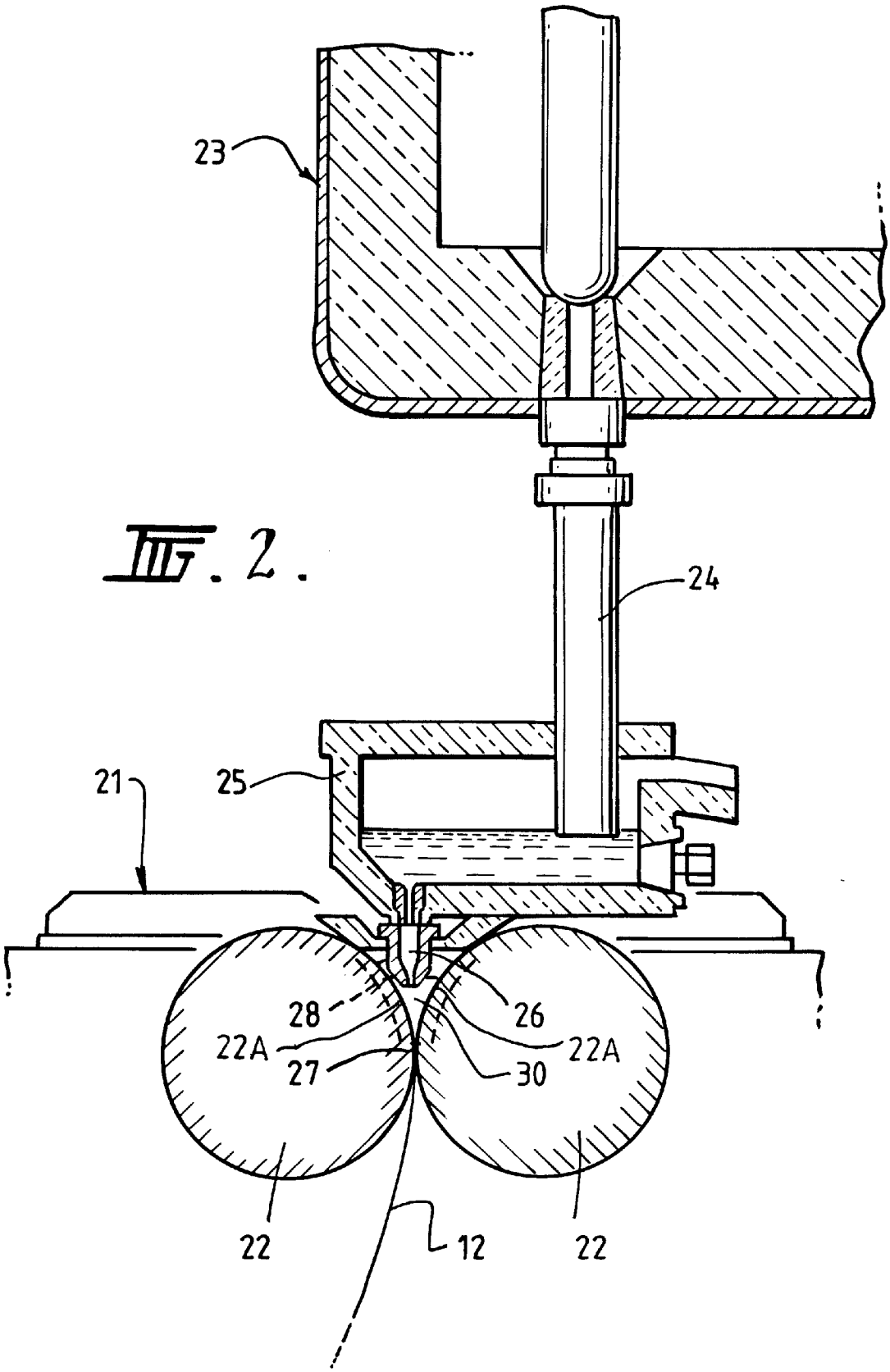
FIG. 2 illustrates essential components of the twin roll caster.
Figure 3:
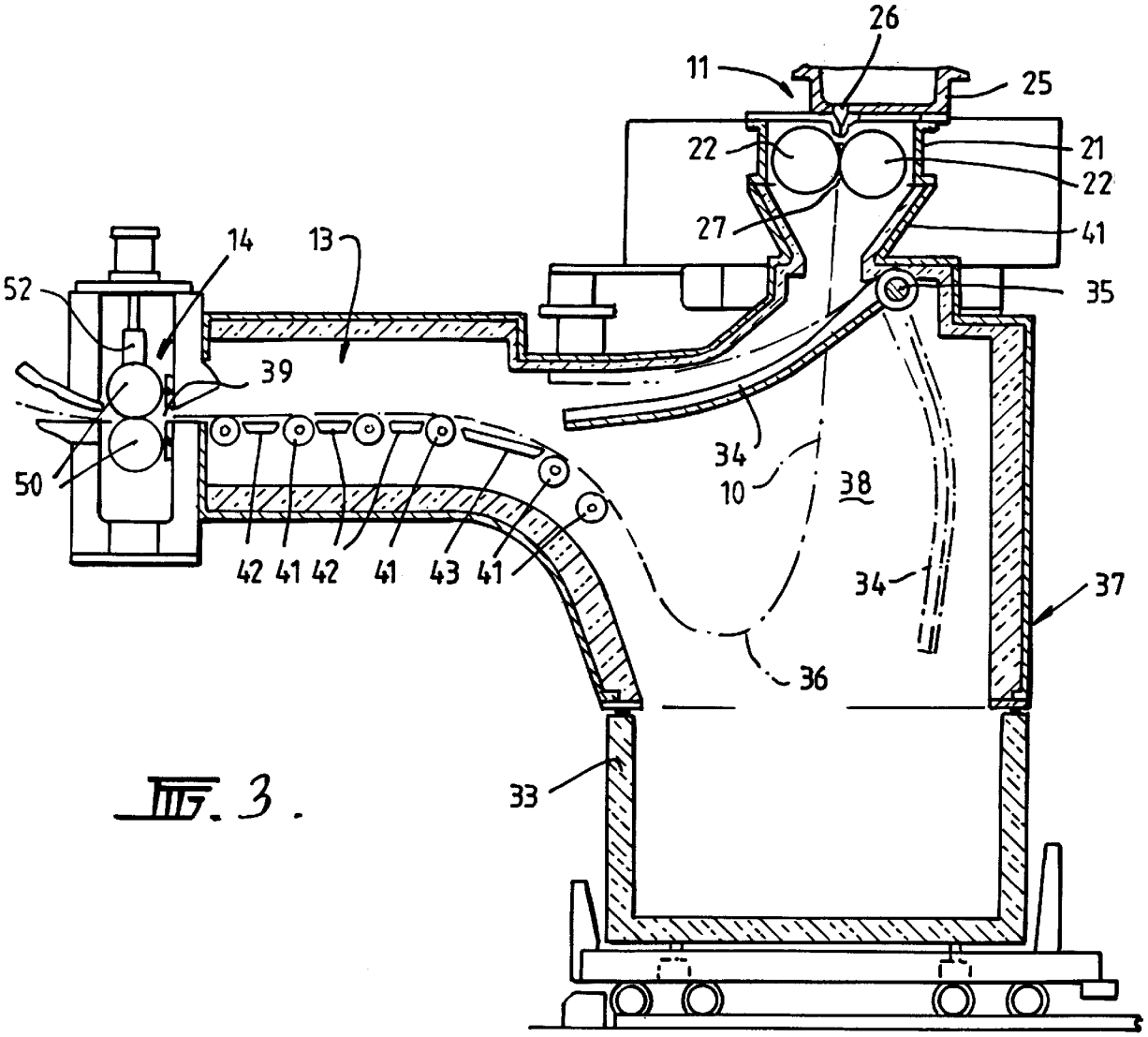
FIG. 3 illustrates the manner in which cast strip produced by the caster is feed in a loop to a set of pinch rolls.
Figure 4:
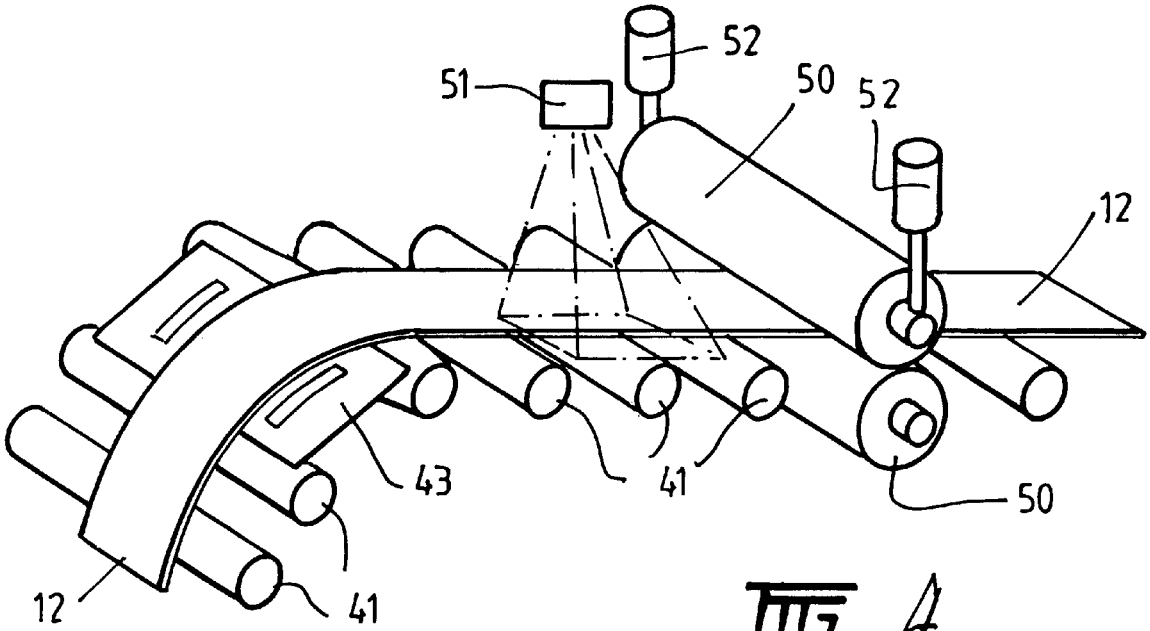
FIG. 4 diagrammatically illustrates the strip feeding and steering system.
Figure 5:
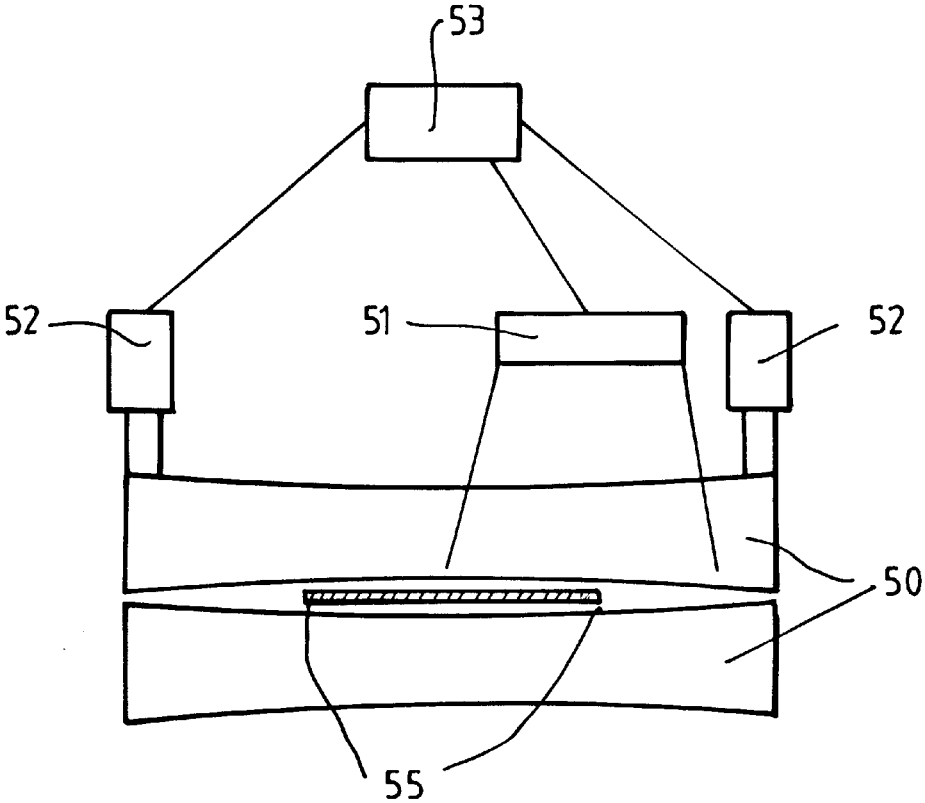
FIG. 5 diagrammatically illustrates the main components of the steering system.

The illustrated casting and rolling installation comprises a twin roll caster denoted generally as 11 which produces a cast steel strip 12 which passes in a transit path 10 across a guide table 13 to a pinch roll stand 14. Immediately after exiting the pinch roll stand 14, the strip passes into an optional hot rolling mill 15 comprising roll stands 16 in which it is hot rolled to reduce its thickness. Thus the strip, whether rolled or not, exits the rolling mill, passes onto a run-out table 17 on which it may be force cooled by water jets 18 and through a pinch roll stand 20 comprising a pair of pinch rolls 20A, and thence to a coiler 19.

Twin roll caster 11 comprises a main machine frame 21 which supports a pair of parallel casting rolls 22 having casting surfaces 22A. Molten metal is supplied during a casting operation from a ladle (not shown) to a tundish 23, through a refractory shroud 24 to a distributor 25 and thence through a metal delivery nozzle 26 into the nip 27 between the casting rolls 22. Molten metal thus delivered to the nip 27 forms a pool 30 above the nip and this pool is confined at the ends of the rolls by a pair of side closure dams or plates 28 which are applied to the ends of the rolls by a pair of thrusters (not shown) comprising hydraulic cylinder units connected to the side plate holders. The upper surface of pool 30 (generally referred to as the "meniscus" level) may rise above the lower end of the delivery nozzle so that the lower end of the delivery nozzle is immersed within this pool.

Casting rolls 22 are water cooled so that shells solidify on the moving roll surfaces and are brought together at the nip 27 between them to produce the solidified strip 12 which is delivered downwardly from the nip between the rolls.

At the start of a casting operation a short length of imperfect strip is produced as the casting conditions stabilise. After continuous casting is established, the casting rolls are moved apart slightly and then brought together again to cause this leading end of the strip to break away in the manner described in Australian Patent 646981 and U.S. Pat. No. 5,287,912 so as to form a clean head end of the following cast strip. The imperfect material drops into a scrap box 33 located beneath caster 11 and at this time a swinging apron 34 which normally hangs downwardly from a pivot 35 to one side of the caster outlet is swung across the caster outlet to guide the clean end of the cast strip onto the guide table 13 which feeds it to the pinch roll stand 14. Apron 34 is then retracted back to its hanging position to allow the strip 12 to hang in a loop 36 beneath the caster before it passes to the guide table 13. The guide table comprises a series of strip support rolls 41 to support the strip before it passes to the pinch roll stand 14 and a series of table segments 42, 43 disposed between the support rolls. The rolls 41 are disposed in an array which extends back from the pinch roll stand 14 toward the caster and curves downwardly at its end remote from the pinch rolls so as smoothly to receive and guide the strip from the loop 36.

The twin roll caster may be of the kind which is illustrated and described in some detail in U.S. Pat. Nos. 5,184,668 and 5,277,243 or U.S. Pat. No. 5,488,988 and reference may be made to those patents for appropriate constructional details which form no part of the present invention.

In order to control the formation of scale on the hot strip the installation is manufactured and assembled to form a very large enclosure denoted generally as 37 defining a sealed space 38 within which the steel strip 12 is confined throughout a transit path from the nip between the casting rolls to the entry nip 39 of the pinch roll stand 14. Enclosure 37 is formed by a number of separate wall sections which fit together at various seal connections to form a continuous enclosure wall. The function and detailed construction of enclosure 37 is fully described in Australian Patent Application 42235/96.

Pinch roll stand 14 comprises a pair of pinch rolls 50 which resist the tension applied by the reduction roll stands 16. Accordingly the strip is able to hang in the loop 36 as it passes from the casting rolls 22 to the guide table 13 and into the pinch roll stand 14. The pinch rolls 50 thus provide a tension barrier between the freely hanging loop and the tensioned downstream part of the processing line. They are also intended to stabilise the position of the strip on the feed table and feed it in to the rolling mill 16. However, it has been found in practice that there is a strong tendency for the strip to wander laterally on the guide table to such an extent as to produce distortions in the shape of the loop with the consequent generation of waviness and cracks in the strip margins and in extreme cases complete disruption of the strip by massive transverse cracking.

In order to control wandering of the strip, pinch rolls 50 are of concave formation so as to grip the strip at two laterally spaced locations at the edges of the strip and a pair of pneumatic or hydraulic cylinder units 52 are disposed one at each end of the pinch roll set and independently operable so as to vary the pressures applied at the two gripping locations whereby to cause a differential in velocities imposed on the strip at those locations and consequently to steer the strip. In this way the pinch rolls can be operated so as not only to feed the strip forwardly but also to steer it according to the differential in the strip gripping intensity at the gripping locations spaced laterally of the strip.

In order to generate a control signal to control the pressure differential applied to the pinch rolls and so control steering of the strip, the position of the strip is monitored in the vicinity of the pinch rolls by a strip position sensor 51 which senses the lateral position of the strip on the guide table. The output of sensor 51 is fed to a controller 53 which generates a control signal to control the operation of the hydraulic cylinder units 52 to steer the strip. It has been found that operation of the steering pinch rolls by a control signal dependent only on the lateral position of the strip is not sufficient to prevent excessive wandering and skewing of the strip. If the operation of the pinch rolls is controlled in this way, continuous strip oscillations can develop in the manner illustrated diagrammatically in FIGS. 6 to 15. In these figures the magnitude of the strip gripping pressure exerted by cylinder 52 at the two ends of the pinch rolls is indicated by the size of the circles at the two ends of the rolls and the desired centre-line for the strip travel is indicated by the chain line in each figure.

Figure 6:
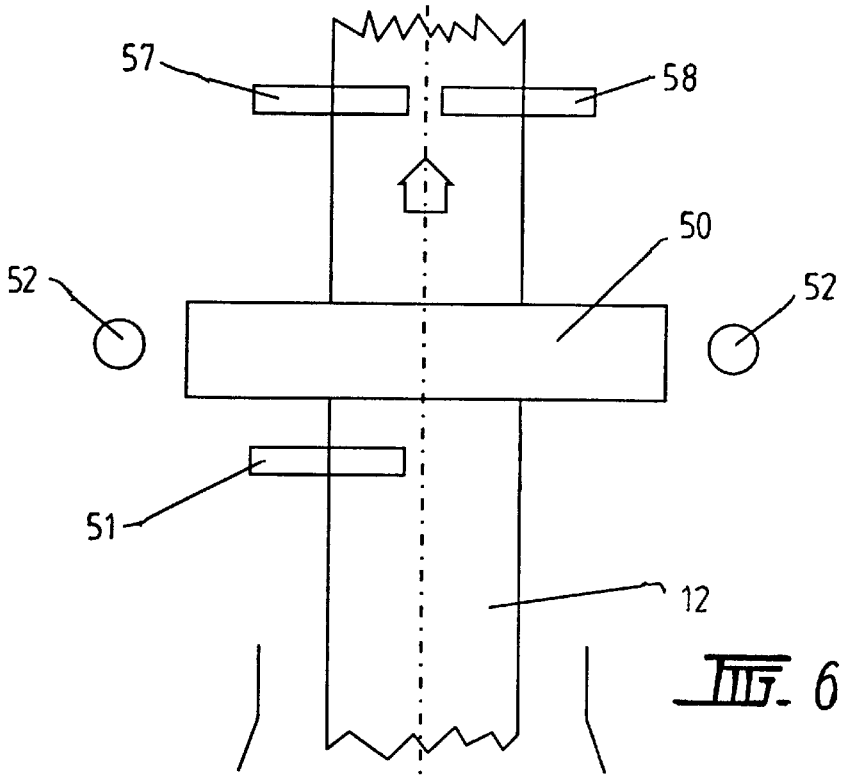
FIGS. 6 to 15 diagrammatically illustrate the manner in which strip oscillations can develop in a system in which the strip is steered only in response to changes in strip position.

FIG. 6 shows the strip travelling forwardly in the correct path and direction with its edge position being continuously monitored by the sensor 51. If the strip skews due to some disturbance such as a variation in the strip profile, the strip will track or move laterally due to the skew and this lateral movement will be detected by the sensor 51. A pressure differential can be applied to the pinch rolls in response to the measurement of the lateral position of the strip to steer the strip. In a system in which the steering control is based solely on the strip position, movement of the strip to the left of centre will cause the pressure control system to apply more pressure on the left and less on the right to make the strip track back toward the right. Similarly if the strip moves to the right of centre more pressure will be applied to the right hand side to make the strip track back toward the left. However, skewing of the strip caused by the strip movement itself generates tracking movement of the strip which cannot be corrected quickly if steering control is determined only by the measurement of strip position.

Figure 7:
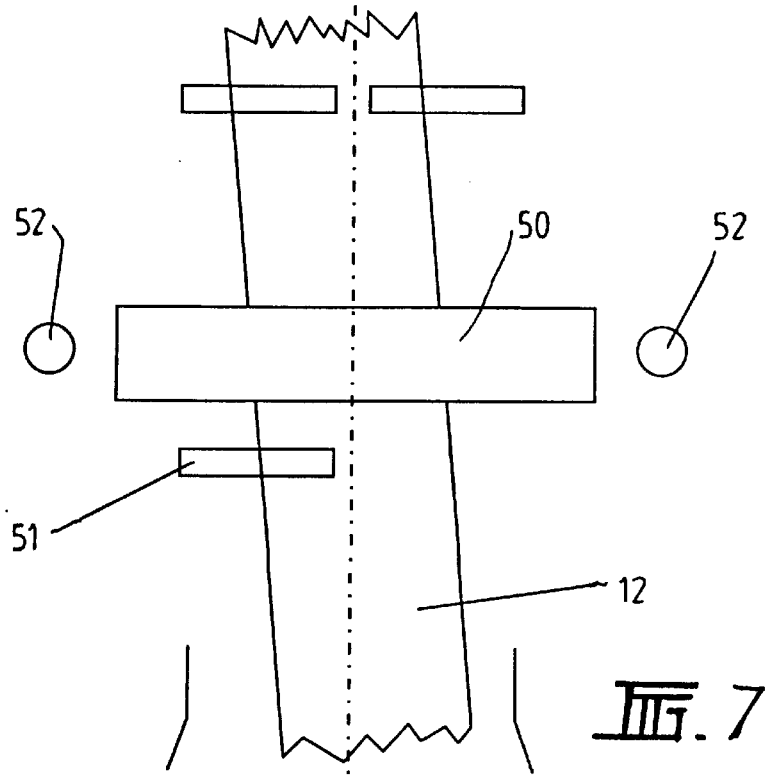
Figure 8:
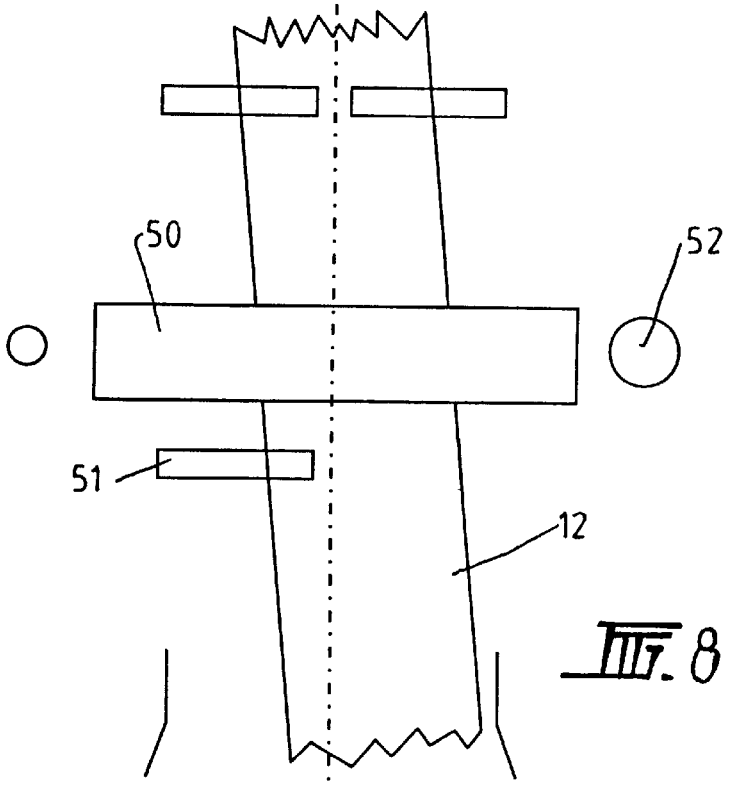
Figure 9:
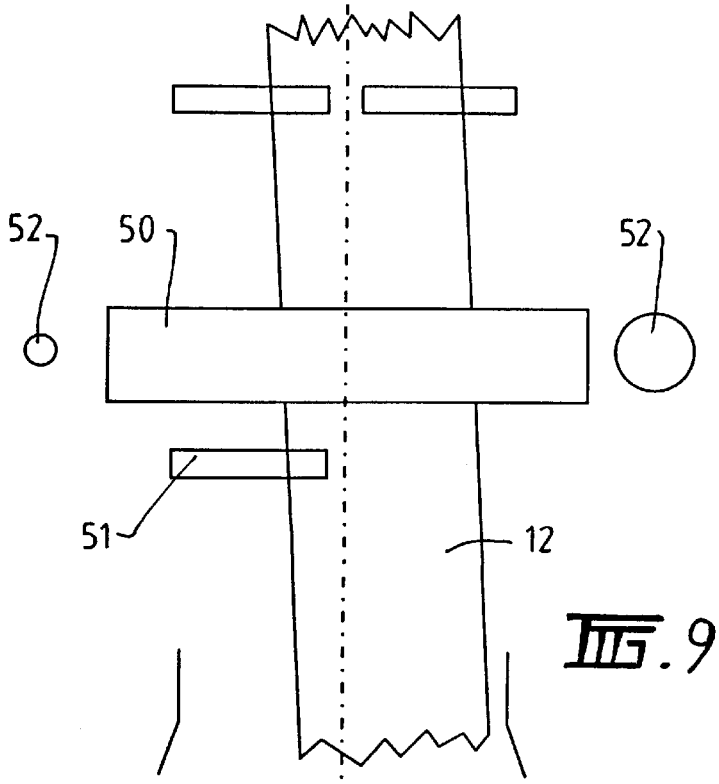
Figure 10:
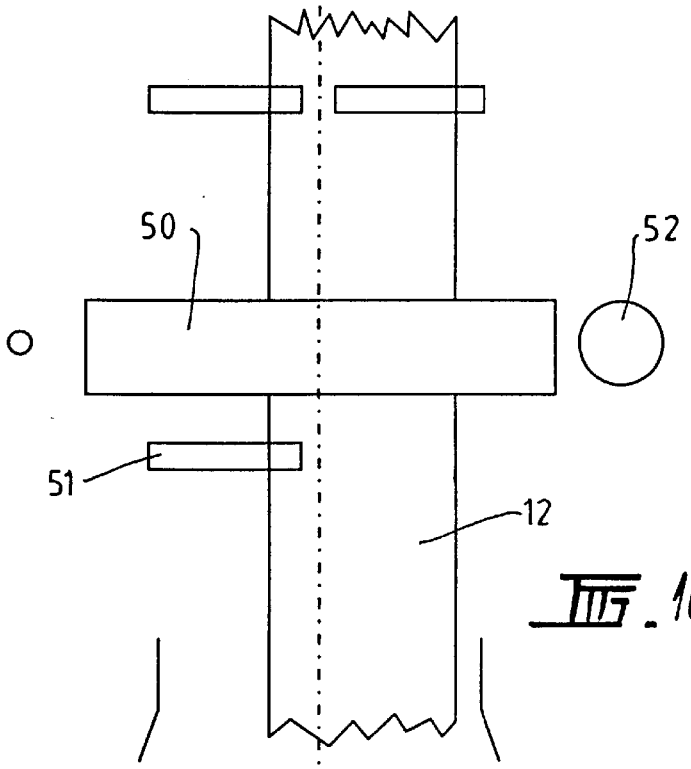
Figure 11:
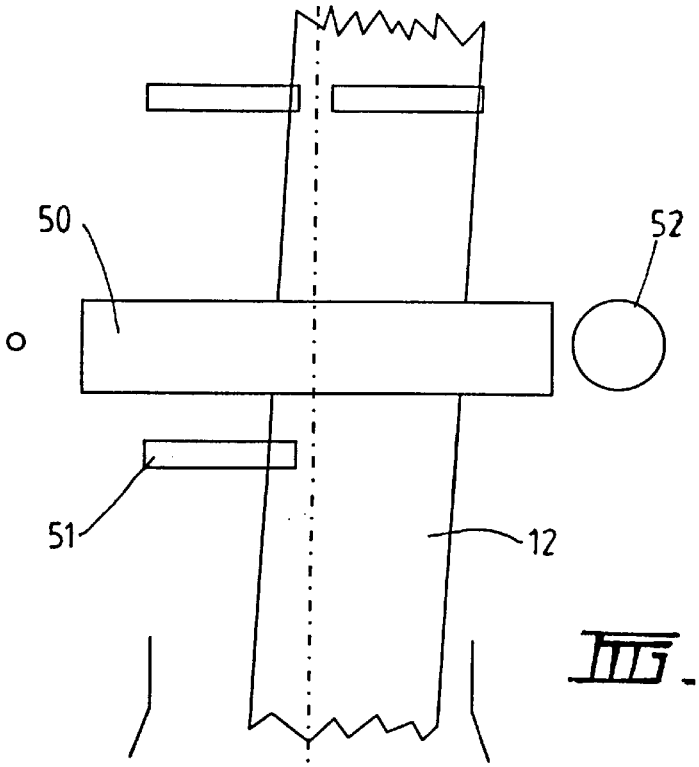
Figure 12:
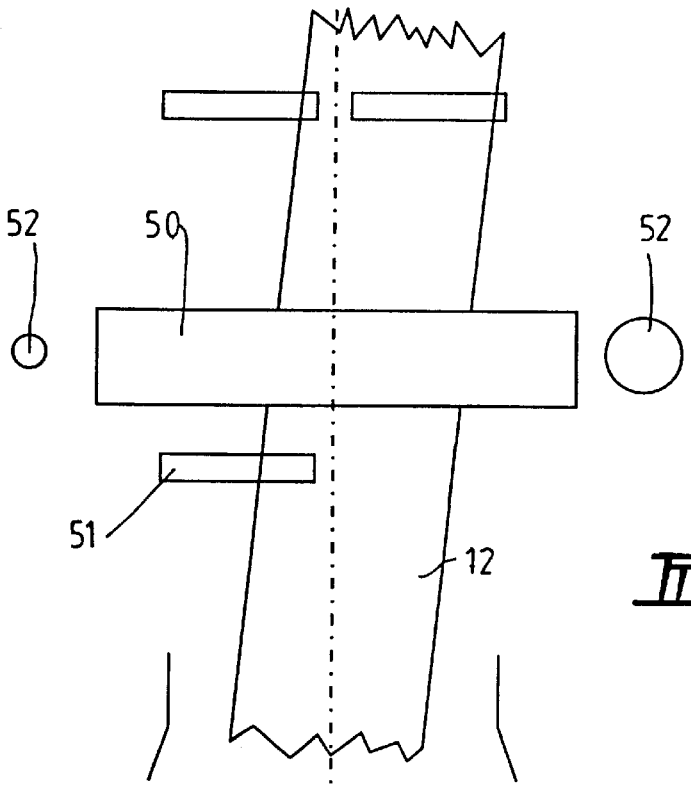
Figure 13:
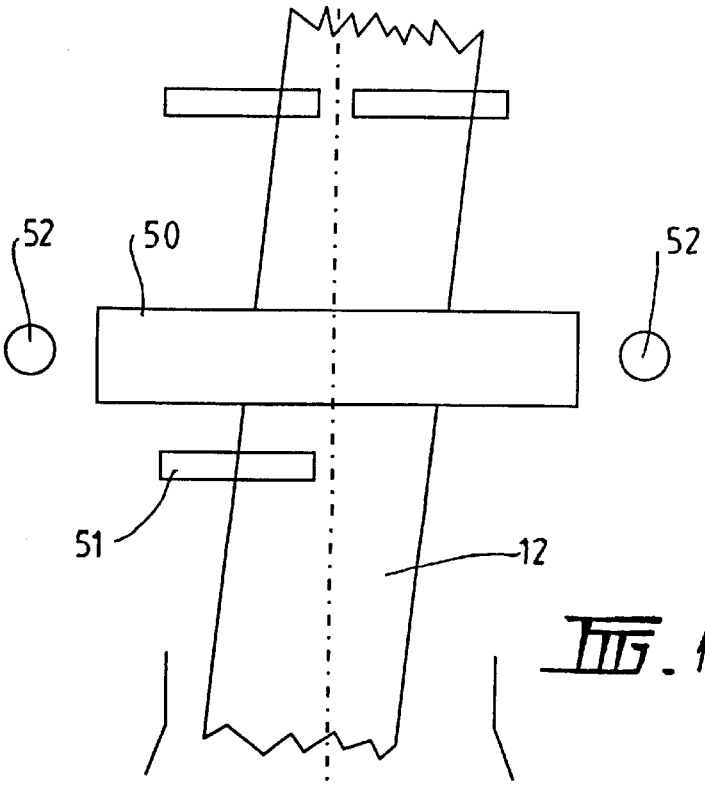
Figure 14:
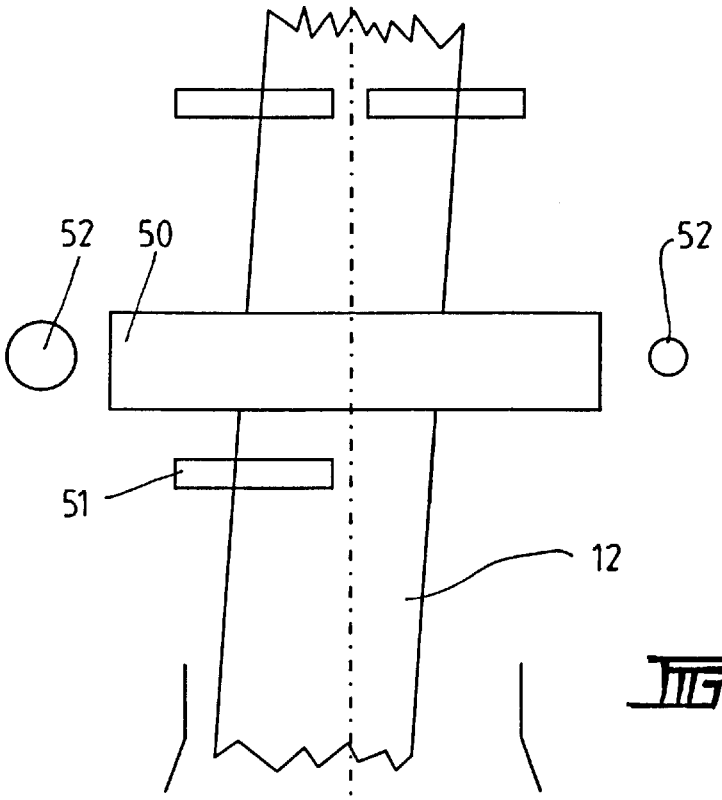
Figure 15:
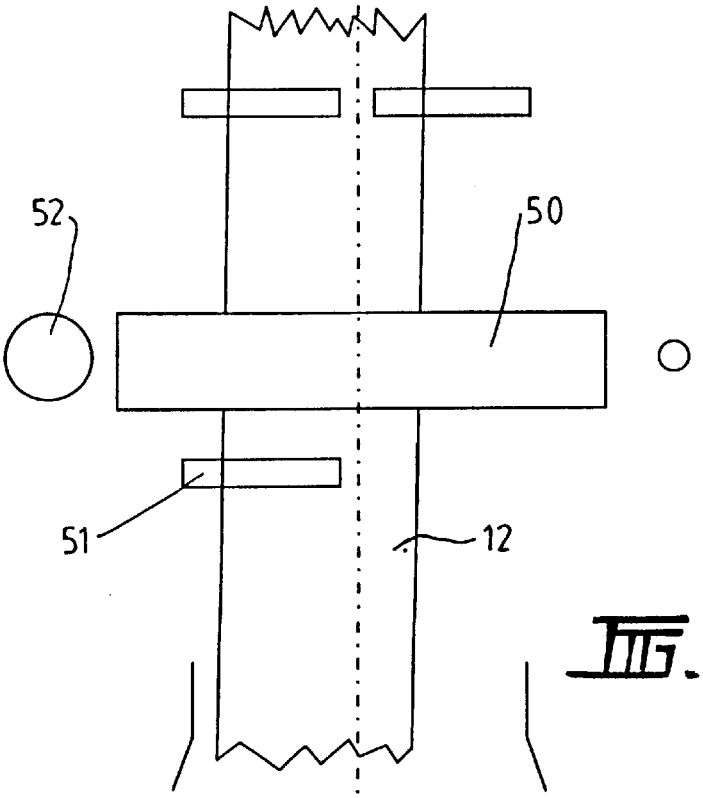

In FIG. 6 the strip is shown travelling in a correct path and in the correct direction. In FIG. 7 the strip has skewed due to some disturbance such as a variation in the cast strip profile or for some other reason with the result that the position of the strip at the sensor 51 has moved to the right. Note that for sensor(s) located downstream of the pinch roll, the strip will initially move in the opposite direction, hence the preference for having the sensor(s) upstream. To counteract the movement seen in FIG. 7, more pressure is applied to the right hand end of the pinch rolls 50 than to the left so as to reduce the strip skew. However, until the strip skew error is corrected to zero, the strip will track on the pinch rolls so as to move further to the right and because of this tracking action the strip can move significantly to the right before the increasing pressure on the pinch rolls brings the strip skew back to zero, as shown in FIGS. 8 to 10. Accordingly the strip straightens up in a position well to the right of the desired path and with a large pressure differential applied to the ends of the pinch rolls, as indicated in FIG. 10, so the strip skew is rapidly changing to bring the strip back to the left. The pinch roll force differential in this condition causes the strip to skew back the other way as illustrated in FIG. 11 and it then tracks back towards the left at a rate which continues to accelerate until the strip is back on centre (FIG. 13) with the consequence that the strip overshoots the central position before it is straightened up by the increasing pressure differential applied to the nip rolls as shown in FIGS. 14 and 15. Accordingly oscillations will continue about the centre-line and there will be repeated skewing of the strip in alternate directions.

It will be appreciated from the above explanation that the oscillation problem is due to tracking of the strip caused by skewing which is not anticipated from mere measurement of strip position. In accordance with the invention the steering control is improved and the oscillations can be dramatically reduced by deriving control signals which are dependent not only on the strip position but also on a measure of the skew of the strip. The measure of skew could be made directly by measuring the instantaneous position of the strip edge at two locations spaced longitudinally of the strip. Alternatively, it may be monitored by differentiation of instantaneous strip edge position measurements at a single location over an extended time interval to obtain a measure of the traversing velocity of the strip which is directly related to the skew at any particular instant. Moreover, since it is the tracking caused by the skew which must be brought under control, it is preferred to heavily weight the influence of the traversing velocity measurement compared with the strip position measurement. In addition, any tendency of the strip to drift from the centre-line will not be picked up by the traverse velocity (differential) control and it is desirable to also include an integration process to sum the errors in the strip position over an extended time interval so as to produce a factor which will determine the overall position of the strip relative to the centre-line and to influence the control signal to push the strip back to the centre-line.

The above three characteristics of a desirable control signal can all be achieved by the use of a proportional/integral/derivative (PID) controller providing a control signal in the form $y=P\times e+I\int e.dt+Dde/dt$ and in which the derivative gain D is set at a much higher value than the proportional gain P. In a preferred system the derivative gain D is set at 30 compared with a position or proportional gain set at 0.5 so that the derivative signals indicative of traversing velocity are weighted at more than 60 times the weighting of the strip position. The integration gain I may be set at a value of the order of 0.2.

The derivative could be further increased but in practice this would result in excessive amplification of signal noise. To counteract that amplification, a fast roll-off low pass filter is applied to the error signal or the input to the derivative component.

Figure 16:
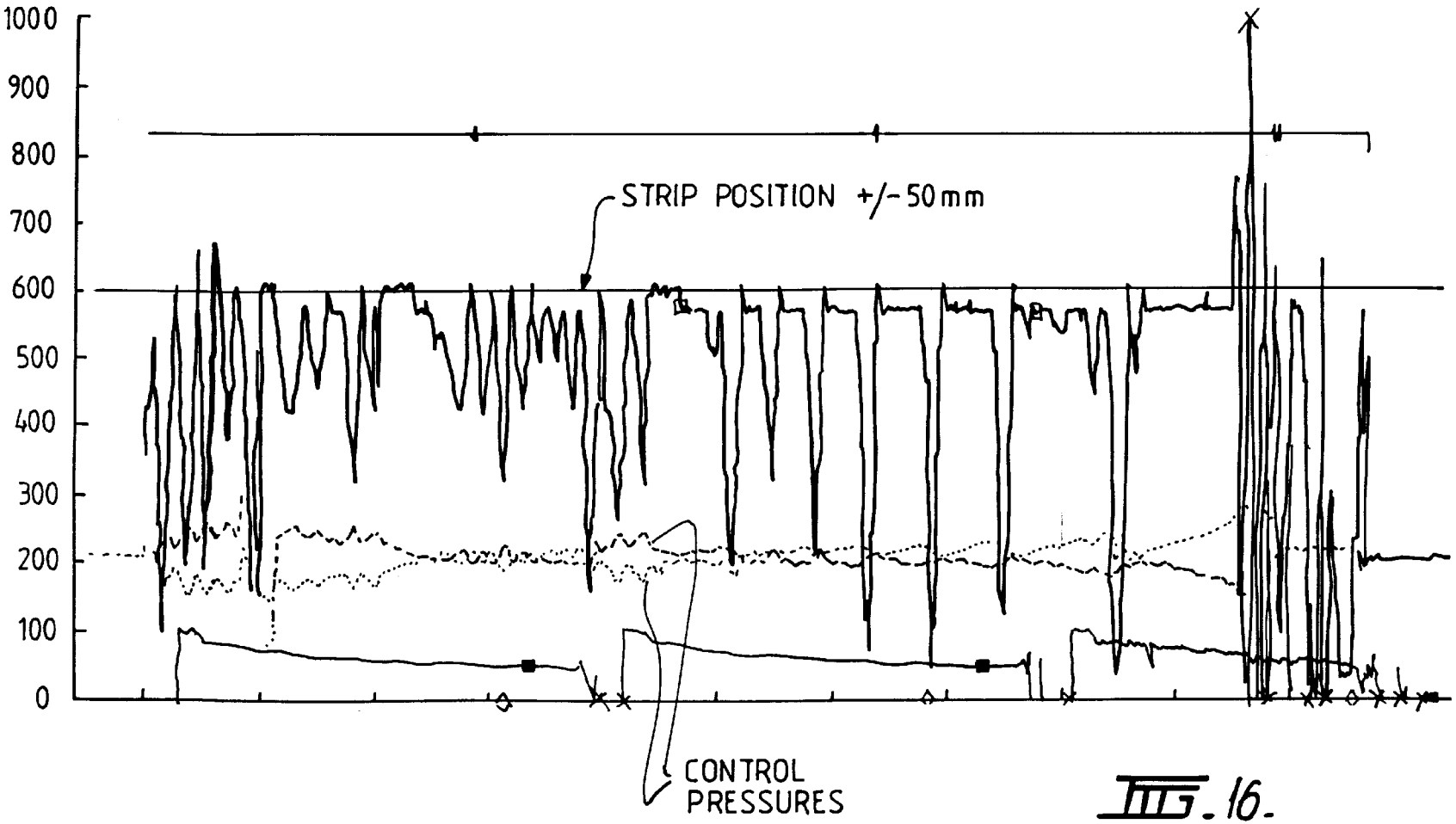
FIG. 16 plots of strip position and differential pressure measurements in a system in which the steering is controlled solely in response to strip position measurements in the manner illustrated in FIGS. 5 to 14.
Figure 17:
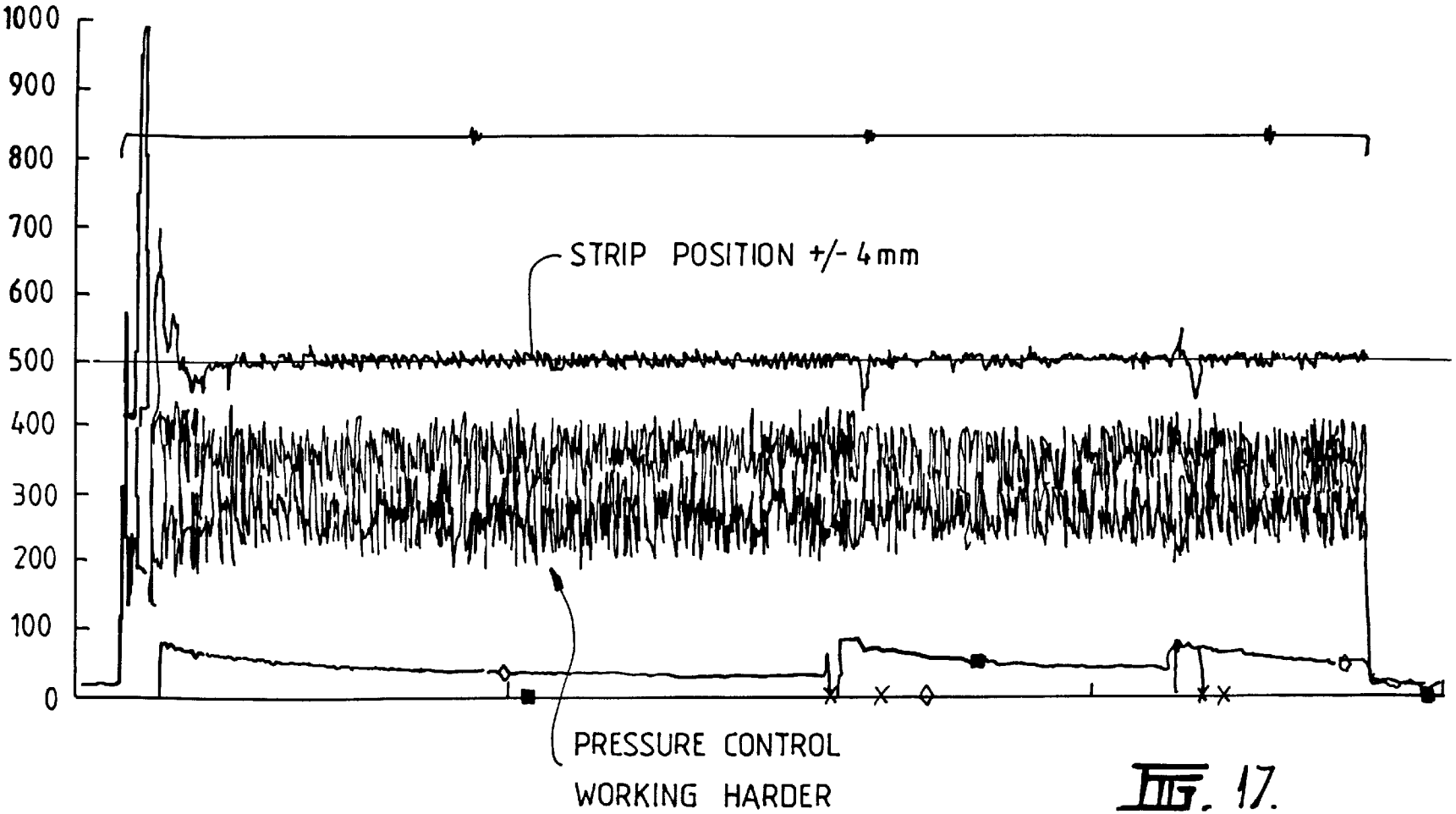
FIG. 17 show plots of strip position and pressure differential measurements obtained by operation of the strip steering system in accordance with the present invention.

The effect of modifying the strip steering control system in a strip caster in accordance with the present invention is quite dramatic as illustrated in FIGS. 16 and 17.

FIG. 16 illustrates movements in strip position and control cylinder pressure obtained during trials on strip produced in a twin roll caster and passed through pinch rolls in which the pressure applied to the ends of the rolls was determined solely by measurements of strip position monitored by a strip edge sensor. It will be seen that the strip position fluctuated regularly through an amplitude of ±50 mm.

FIG. 17 illustrates strip movements and the control pressures during steering of a strip through a steering system modified in accordance with the present invention. It will be seen that the pressures on the ends of the pinch rolls are caused to change much more sharply and frequently and that oscillations of the strip are dramatically reduced in amplitude to the order of ±4 mm.

It would also be possible in accordance with the invention to modify the pinch rolls 20A downstream of the rolling mill 16 to provide steering of the strip both upstream and downstream of the reduction mill. Upstream of the reduction mill the strip is at a temperature of the order of 1300° C. and the pinch roll pressure on the pinch rolls 50 can be much less than the pressure which would need to be applied to the rolls 20A for steering and gripping. In a typical installation the pinch rolls 50 could be actuated by pneumatic cylinders to apply pressures of the order of 13±5 kNewtons per side whereas the rolls 20A could be actuated by hydraulic cylinder units applying 80±40 kNewtons per side. The pressure required for steering is not particularly sensitive to strip thickness but it will vary according to the width of the strip.

The illustrated apparatus has been advanced by way of example only and it could be varied considerably. For example, it would be possible to provide additional sensors 53, 54 to provide a direct measure of the strip skew. Further, a separate set of sensors at each side of the strip and the measurements of the sensors averaged to minimise the effect of localised variations in strip edge shape at the sensor locations. It is not essential that steering be carried out by a pair of concave pinch rolls and it would be possible to use a concave roll in combination with a straight roll. Indeed, the rolls could be shaped to other profiles to provide the necessary spaced gripping locations. It is not necessary to employ pinch rolls extending across the complete width of the strip and it would be possible to use narrow steering rolls spaced apart laterally of the strip, not necessarily at the margins of the strip. As already mentioned the invention can be applied to any equipment in which a strip must be steered along a desired path and in other applications feed roll arrangement could be varied considerably. It is accordingly to be understood that the invention is in no way limited to the details of the illustrated construction and that many variations will fall within the scope of the appended claims.

What is claimed is:

1. A method of steering a traveling strip along a desired longitudinal path, comprising:

gripping the strip by strip feed means at locations spaced laterally of the strip;

monitoring a position of the cast strip in the vicinity of the strip feed means to detect changes in a lateral position of the strip and in either a lateral traversing velocity or skew of the strip;

generating a strip steering control signal dependent on both an instantaneous lateral position of the strip and an instantaneous lateral traversing velocity or skew of the strip; and varying a relative strip gripping intensity of the feed means at said locations to steer the strip in accordance with said control signal.

2. A method as claimed in claim 1, wherein the control signal is generated giving greater weight to either the laterally traversing velocity or skew of the strip than is given to the instantaneous position of the strip.

3. A method as claimed in claim 2, comprising generating control signal so to give the lateral traversing velocity or skew at least 10 times more weight than the instantaneous position of the strip.

4. A method as claimed in claim 1, comprising generating the control signal so as to be also dependent on integration of instantaneous values of the lateral position of the strip to counteract lateral drift of the strip from a desired centre-line.

5. A method as claimed in claim 4, wherein in generating the control signal, the contribution to the control signal by the integration of instantaneous values of the lateral position of the strip is given less weight than the contribution of the values of the instantaneous position of the strip.

6. A method as claimed in claim 5, wherein the integration values are given at least 25 times less weight than the strip position values.

7. A method as claimed in claim 1, wherein the lateral traversing velocity or skew of the strip is measured by continuously differentiating the instantaneous values of the lateral position of the strip.

8. A method as claimed in claim 1, wherein the skew of the strip is measured directly by monitoring instantaneous positions of the strip at two locations spaced longitudinally of the strip.

9. A method as claimed in claim 1, comprising generating the control signal as the sum of three factors the first of which is a measure of the instantaneous lateral position of the strip, the second of which is a measure of the instantaneous lateral traversing velocity of the strip and the third of which is an integration of instantaneous values of the lateral position of the strip over a preceding time interval.

10. A method as claimed in claim 9, comprising obtaining the second factor by filtering signals derived by differentiating processing of instantaneous lateral position measurements over a preceding time interval.

11. A method as claimed in claim 1, wherein said strip is a ferrous strip issuing from a twin roll strip caster at a temperature above 1100° C., the strip is delivered downwardly from the nip between a pair of casting rolls of the strip caster and is guided in a substantially untensioned state to said strip feed means which feeds the strip away from the strip caster and serves as a tension barrier against which tension may be applied to the strip downstream from the feed means.

* * * * *